US011104020B2

(12) United States Patent
Martin et al.

(10) Patent No.: US 11,104,020 B2
(45) Date of Patent: Aug. 31, 2021

(54) RAZOR HANDLE AND METHOD OF MANUFACTURE

(71) Applicant: Harry's, Inc., New York, NY (US)

(72) Inventors: Tevis Koll Martin, New York, NY (US); Scott Newlin, Brooklyn, NY (US); Brittania Boey, New York, NY (US)

(73) Assignee: Harry's, Inc., New York, NY (US)

( * ) Notice: Subject to any disclaimer, the term of this patent is extended or adjusted under 35 U.S.C. 154(b) by 144 days.

(21) Appl. No.: 15/061,128

(22) Filed: Mar. 4, 2016

(65) Prior Publication Data

US 2017/0252935 A1 Sep. 7, 2017

(51) Int. Cl.
*B26B 21/52* (2006.01)

(52) U.S. Cl.
CPC ..... *B26B 21/522* (2013.01); *B26B 21/528* (2013.01)

(58) Field of Classification Search
CPC ..... B26B 21/522; B26B 21/528
See application file for complete search history.

(56) References Cited

U.S. PATENT DOCUMENTS 3,435,521 A * 4/1969 Kuhnl ..... B26B 21/32 30/34.05
3,810,305 A * 5/1974 Perry ..... B26B 21/24 30/47
5,027,011 A 6/1991 Steele
5,107,590 A * 4/1992 Burout, III ..... B25G 1/10 30/47
5,787,586 A * 8/1998 Apprille, Jr. ..... B26B 21/225 30/47
6,115,618 A * 9/2000 Lebby ..... G06F 1/1616 379/433.04
9,616,584 B2 * 4/2017 Coresh ..... B29C 45/0005
2003/0070309 A1 4/2003 Brown et al.
2005/0172493 A1 * 8/2005 Fischer ..... B26B 21/38 30/45
2006/0260142 A1 * 11/2006 Dombrowski ..... B26B 21/38 30/526
2007/0070309 A1 3/2007 Stern
2013/0029139 A1 11/2013 Gajria et al.
2014/0366327 A1 * 12/2014 Huang ..... B25G 1/04 16/421

FOREIGN PATENT DOCUMENTS

WO 2006/081839 A1 8/2006

* cited by examiner

*Primary Examiner* — Kenneth E Peterson
*Assistant Examiner* — Liang Dong
(74) *Attorney, Agent, or Firm* — Florek & Endres PLLC

(57) ABSTRACT

A razor handle and method of manufacture, the razor handle having a connection member for connecting a razor blade cartridge to the handle, a core member, a cap member attached to the core member and an overmolded member surrounding the core member and bounded by the cap member, where the overmolded member and cap member form portions of the exterior surface of the handle.

10 Claims, 7 Drawing Sheets

RAZOR HANDLE AND METHOD OF MANUFACTURE

FIELD OF THE INVENTION

The present invention relates to the field of shaving razor handles and more particularly to the field of razor handles attaching replaceable razor cartridges.

BACKGROUND OF THE INVENTION

Shaving razors have evolved over the years from a straight edge razor, having a razor edge that needed to be sharpened from time to time, to a safety razor having a unitary handle and head, the head being opened to receive replaceable blades, to a handle and razor cartridge system. In the handle and cartridge system, a razor cartridge having integrated blades and a handle connection member is removeably attached to a handle having a cartridge connection member for replacement of a used razor cartridge on the reusable handle.

The removable attachment of razor cartridges to handles provides that the handles can be more substantial than disposable handles, which are generally formed of thin plastic. More particularly, razor handles have been formed of natural materials, such as bone and horn, ceramics, metals, including precious and non-precious metals, wood and other suitable materials. They have also been formed of plastics and other manmade materials, including combinations of natural and manmade material.

Notwithstanding differences in the handles themselves, a common feature of all such handles is that they have connection means for removeably attaching a disposable razor cartridge to the handle. Of course, many of the connections are specific to a particular manufacturer, or even proprietary; however, a connection means is required to connect the razor cartridge to the handle. Other features found to be important to consumers is the weight and feel of the handle, where handles that have additional weight and a slip-resistant surface on the portions that the user holds while shaving appear to be preferred.

To address the consumer's preferences in razor handles, not only are the materials significant, but the location of component materials and the method of manufacture can be significant. Examples of known razor handles that address the location of gripping portions and the method of manufacture are found in U.S. Pat. Nos. 5,890,296 and 5,822,869. These patents are directed to razor handles formed of various components, including frame members and gripping portions attached to the frame members and/or other gripping portions during manufacture.

Despite the existence of unitary razor handles having a cartridge connection member and razor handles made of component parts that are assembled to create a razor handle, there is a need for razor handles that are comfortable in the user's hand and easy to manufacture.

SUMMARY OF THE INVENTION

The present invention is directed to a razor handle and method of manufacture. The razor handle comprises a connection member for connecting a razor blade cartridge to the handle, a core member, a cap member attached to the core member and an overmolded member surrounding the core member and bounded by the cap member, where the overmolded member and cap member form portions of the exterior surface of the handle. The connection member for attaching the razor blade cartridge can be formed integrally with the core member or can be attached to the core member during the manufacture process.

The core member may be formed as a unitary structure in the desired shape by molding, casting, machining, or by any known method to create the desired structure. However, the core member may further comprise a weighted element that forms a part of the core member. In a preferred embodiment, the weighted element, when used as a component of the core member, comprises a cast metal over which is injection molded a covering element, where the weighted element and covering element together form the core member. Most preferably, the weighted element is completely encased by the covering element to form the core member, however, the covering element may cover only a portion of the weighted element.

The shape of the core member includes a terminal portion that is configured to engage the cap member, so that the cap member can be attached to the core member during the manufacturing process. In its preferred embodiment, the core member has a terminal portion which is received in a hollow portion of the cap member, so that the cap member covers a portion of the core member and serves as a portion of the exterior surface of the handle. The cap member preferably creates a ledge, either at an end of the cap or an intermediate portion of the cap, against which the overmolded member is bounded when the cap member is attached to the core member.

The cap member may be formed by any technique and of any suitable material, including being formed of a metal by casting, forging, milling, machining, etc., a wood or stone material or composite material, by casting, milling, machining, etc. or a plastic, resin, synthetic, or other manmade material by injection molding, casting, machining, etc., with the cap member being formed by injection molding a plastic material being most preferred. In an embodiment, the cap member is formed as a separate part and then attached to the core member, preferably by manually pressing the cap member onto the core member for a friction fit. In another embodiment, the cap member is formed by injection molding directly onto the core member, as an additional step after the core member has been formed, thereby attaching the cap member on the core member.

The overmolded member of the handle covers at least a portion of the core member, bounded by the cap member, by overmolding on the core member up to the cap member, and optionally over a recessed portion of the cap member, to form a portion of the exterior surface of the handle. Preferably, the overmolded member covers the remainder of the exterior surface of the core member not covered by the cap member, a razor blade cartridge affixed to the connection member, or another handle component, such as a pusher, etc. In its preferred embodiment, the overmolded member is formed of a tactile material, and preferably a thermoplastic elastomer, thermoplastic rubber, or similar material that is comfortable to the touch and provides an improved friction even when wet.

The handle can have any suitable connection member, to removably retain a razor blade cartridge on the handle. The connection member can be formed as a unitary structure with the core member or can be attached to the core member after the core member has been formed. It can be a static connection member, formed of non-moving parts with structural formations or magnetic elements that are engaged by cooperating structural parts or magnetic elements on the razor blade cartridge to retain the razor blade cartridge on the handle, or a dynamic connection member, with moving parts, springs, latches, etc., that cooperate with structural parts on the razor blade cartridge to retain the razor blade cartridge on the handle. Both types of connection members are well known in the art, with examples of dynamic connection members shown in U.S. Pat. Nos. 5,787,586 and 5,784,790.

When a static connection member is used to retain the razor blade cartridge, the handle may also comprise a "pusher" that aids in pushing the razor blade cartridge off of the connection member. Since such static connection members generally rely on a friction fit, including one or more detents, depressions, catches, etc., or magnetic connection, removal generally only requires a sufficient force be delivered to the razor blade cartridge to displace it from the connection member. In such cases, a slideable pusher, which travels a distance generally related to the distance required to push the razor blade cartridge off of the connection member, may be placed on the connection member.

When the user wishes to remove the razor blade cartridge attached to the handle, they manually activate the pusher, which in turn pushes the razor blade cartridge. Attaching a new razor blade cartridge moves the pusher back against the handle portion, where it rests until needed to push the razor cartridge off of the connection member for replacement.

The pusher can have any structural form, including being merely an injection molded plastic part that is slid onto the connection member, or may include additional features, such as a overmolded portion of TPE or TPR on a plastic part.

The invention is also directed to the manufacture of the handle, comprising the steps of forming a core member, forming a cap member, affixing the cap member to the core member, injection molding an overmolded member over at least a portion of the core member to form at least a portion of an exterior surface of the handle, wherein the overmolded member is bounded at least in part by the cap member.

The step of attaching a connection member or portion thereof may be included to add a connection member when the entire connection member is not formed as part of the core member. Preferably, any portion of the connection member not formed as part of the core member may be attached to the core member or razor handle by any suitable method. Similarly, the step of attaching a pusher on the connection member, when desired, may be included when the connection member is a static connection member, preferably by sliding the pusher over at least a portion of the connection member. The pusher can be manufactured by any suitable method prior to attachment to the razor handle, including by injection molding a pusher core and injection molding a material, and preferably the material of the overmolded member, onto the pusher core.

BRIEF DESCRIPTION OF THE DRAWINGS

The present invention will be better understood when considered in view of the attached drawings, in which like reference characters indicate like parts. The drawings, however, are presented merely to illustrate the preferred embodiments of the invention without limiting the invention in any manner whatsoever.

DETAILED DESCRIPTION OF THE PREFERRED EMBODIMENTS

Figure 1D:
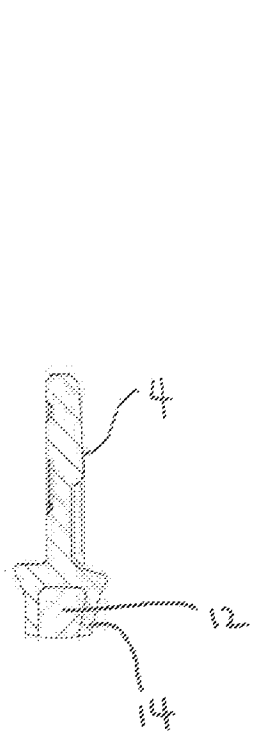
FIG. 1D is a partial cross-sectional side elevation of a preferred embodiment of the core member shown within circle D of FIG. 1C.

As shown in the drawings, the present invention is directed to a razor handle 2 and method of manufacture, the razor handle 2 comprising a connection member 4 for connecting a razor blade cartridge to the handle 2, a core member 6, a cap member 8 attached to the core member 6 and an overmolded member 10 surrounding the core member 6 and bounded by the cap member 8.

As shown in FIGS. 1A-1C and FIG. 7, the core member 6 forms the underlying frame of the razor handle 2 on which the remaining components are fashioned. The core member 6 may be formed as a unitary structure of a single material (shown in FIG. 7) or as a composite structure with a weighted element 12 and a covering element 14 (shown in FIGS. 1A-1C). When the core member 6 is formed of a unitary material, it is preferred that it be formed by injection molding a plastic material into the desired shape of the core member 6, including the connection member 4 or means for attaching the connection member 4. Similarly, when the core member 6 is formed as a composite structure, the covering element 14 is formed over the weighted element 12 into the desired shape of the core member 6.

Figure 1C:
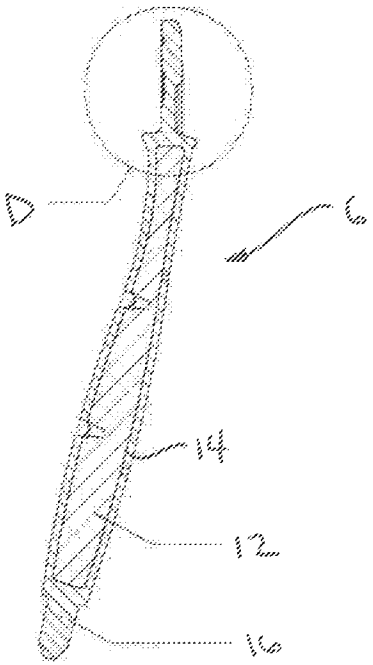
FIG. 1C is a cross-sectional side elevation of a preferred embodiment of the core member shown in FIG. 1A.
Figure 1B:
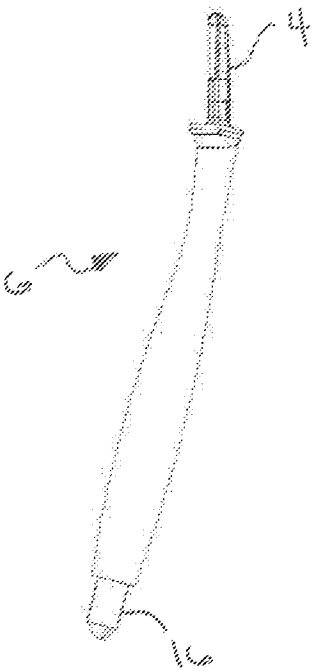
FIG. 1B is a side elevation of a preferred embodiment of the core member shown in FIG. 1A.
Figure 1A:
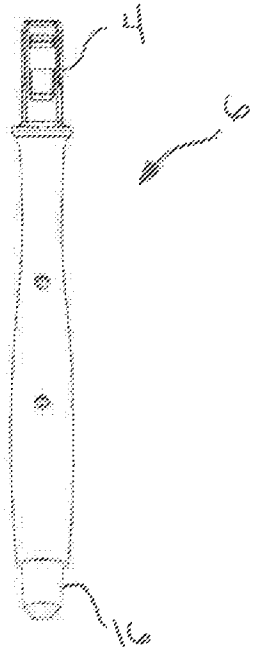
FIG. 1A is a front elevation of a preferred embodiment of the core member of the present invention with a unitary connection member.
Figure 3A:
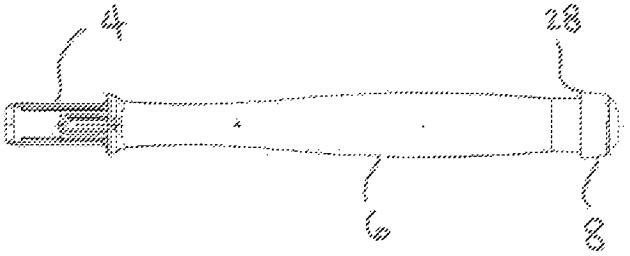
FIG. 3A is a front elevation of a preferred embodiment of the core member of the present invention shown in FIG. 1A with the cap member attached.
Figure 3B:
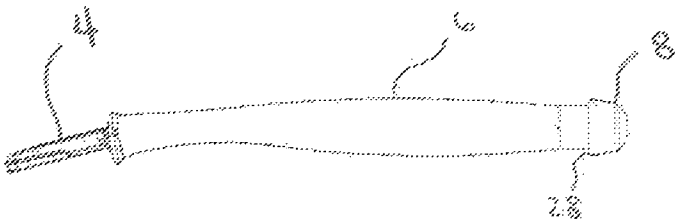
FIG. 3B is a side elevation of a preferred embodiment of the core member of the present invention with the cap member attached, as shown in FIG. 3A.
Figure 3C:
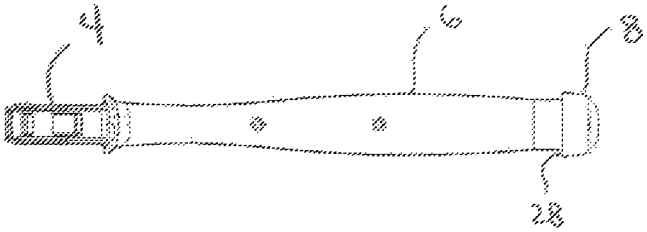
FIG. 3C is a rear elevation of a preferred embodiment of the core member of the present invention with the cap member attached, as shown in FIG. 3A.
Figure 2A:
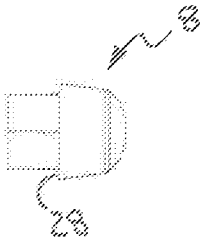
FIG. 2A is a side elevation of a preferred embodiment of the cap member for use with the core member shown in FIG. 1A.
Figure 2B:
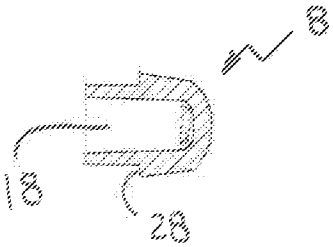
FIG. 2B is a cross-sectional side elevation of a preferred embodiment of the cap member shown in FIG. 2A.
Figure 4B:
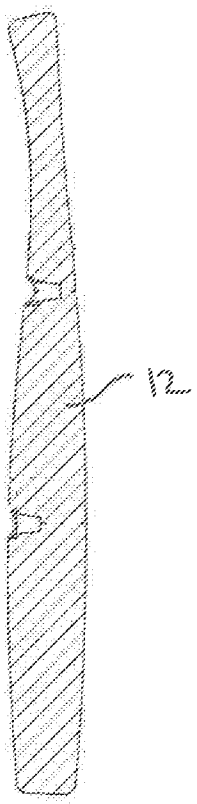
FIG. 4B is a cross-sectional side elevation of a preferred embodiment of the weighted element of the core member shown in FIG. 4A.
Figure 4A:
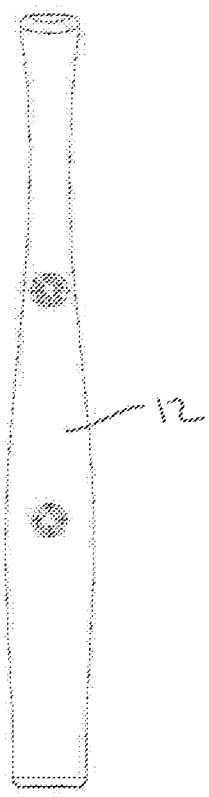
FIG. 4A is a rear elevation of a preferred embodiment of a weighted element of the core member shown in FIG. 1C.
Figure 5C:
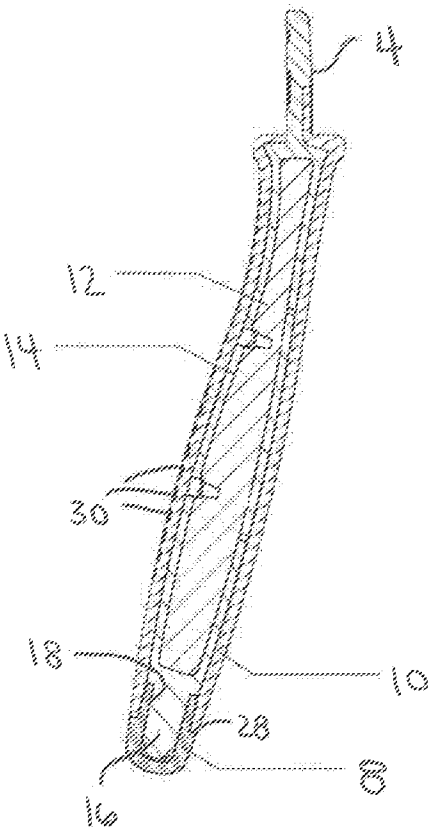
FIG. 5C is a cross-sectional side elevation of a preferred embodiment of the handle shown in FIG. 5B.
Figure 5B:
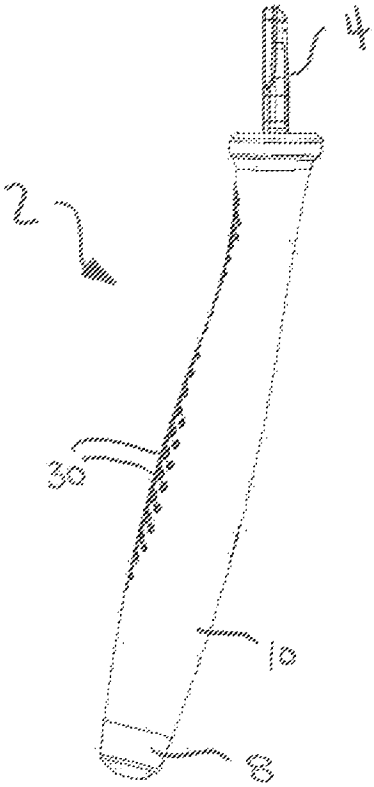
FIG. 5B is a side elevation of a preferred embodiment of the handle shown in FIG. 5A.
Figure 5A:
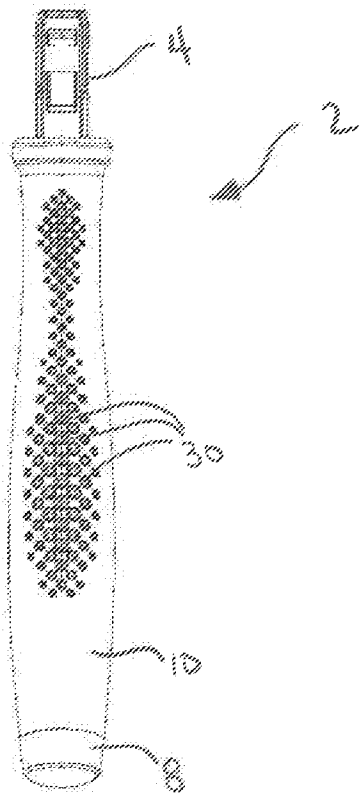
FIG. 5A is a rear elevation of a preferred embodiment of the handle of the present invention with the overmolded member molded over the core member and bounded by the cap at the distal end.

In the preferred embodiment shown in FIGS. 1A-1C, the weighted element 12 of the core member 6 (shown in FIGS. 4A and 4B) comprises a cast metal component, such as a zinc alloy, over which a plastic material of the covering element 14 is injection molded, to form the core member 6. Most preferably, the weighted element 12 is virtually completely, including almost and completely, encased by the covering element 14 to form the core member 6, with the connection member 4 formed of the material of the covering element 14 during injection molding. Of course, the outer member 14 may cover only a portion of the weighted element 12, or the core member 6 may comprise means for attachment of the connection member 4 rather than the connection member 4 itself, as a matter of design choice.

The shape of the core member 6 includes a terminal portion 16 that is configured to engage the cap member 8, so that the cap member 8 can be attached to the core member 6 during the manufacturing process. In its preferred embodiment, the terminal portion 16 of the core member 6 is received in a hollow portion 18 of the cap member 8, shown in FIGS. 2A, 2B, 5C, 7, 8 and 9), so that the cap member 8 covers a portion of the core member 6, with at least a portion of the cap member 8 serving as a portion of the exterior surface of the razor handle 2.

The cap member 8 is preferably formed by injection molding a plastic material into a unitary component having the desired shape. The shape of the cap member 8 preferably creates a ledge 28 when the cap member 8 is placed on the core member 6, such that the ledge 28 acts as a boundary against which the overmolded member 10 terminates. Although any suitable plastic material can be used for the cap member 8, an acrylonitrile butadiene styrene (ABS) plastic is preferred due to its favorable appearance on the outer surface of the razor handle 2. Of course, the cap member 8 can be formed of other natural or man-made materials, the selection of which is a matter of design choice.

Once formed, the hollow portion 18 of the cap member 8 is fitted over the terminal portion of the core member 6 and attached to the core member 6 by friction (being pressed onto the core member 6), spring force, heat or chemical adhesion, including adhesives such as resins, glues, or other attachment means. The core member 6 with cap member 8 attached, as shown in FIGS. 3A-3C and 9, receives the overmolded member 10, preferably on the remainder of the outer surface of the core member 6 not comprising the cap member 8, the connection member 4, or any feature related to the connection member 4 such as a pusher 20 (if used), the razor blade cartridge (not shown), etc.

The overmolded member 10 of the razor handle 2 is bounded by the cap member 8, by overmolding on the core member 6 up to the cap member 8, to form a portion of the exterior surface of the razor handle 2. This is preferably achieved in the manufacture of the razor handle 2 by placing the core member 6 with the cap member 8 attached into an injection molding cavity that is open in the area above the core member 6 and up to an inner edge of the cap member 8, and injection molding the overmolded member 10 onto the core member 6 within the cap member 8.

In the preferred embodiment, the overmolded member 10 is formed of a tactile material, and preferably a thermoplastic elastomer (TPE), thermoplastic rubber (TPR), or similar material that is comfortable to the touch and provides improved friction for grasping the razor handle 2 even when wet. The outer surface of the overmolded member 10 may have surface features 30 that further assist in grasping the razor handle 2 even when wet, including dimples or indentations, gnarling, ribs or grooves, or any other embossed or debossed structure.

The connection member 4 of the razor handle 2 is generally one of two cooperating connection members that work together to removably retain a razor blade cartridge on the razor handle 2, the other cooperating member being found on the razor blade cartridge. The present invention contemplates the use of any suitable connection member 4 which can include a connection member 4 formed as a unitary structure with the core member 6 or attached to the core member 6 after the core member 6 has been formed.

When a static connection member 4 is used, generally understood to be one without moving parts and relying on structural formations or magnetic elements to hold the razor blade cartridge on the razor handle 2, the razor handle 2 may further comprise a pusher 20, as shown in FIGS. 6A-6B and 12A-12C, that aids in pushing the razor blade cartridge off of the connection member 4. Such a pusher 20 generally surrounds the connection member 4, with stop means (not shown) limiting the travel of the pusher 20 on the connection member 4 so that it does not slide off of the end of the connection member 4. Since such static connection members generally rely on a friction fit or magnetic element to hold the razor blade cartridge on the razor handle 2, the pusher 20 can be activated by manually sliding the pusher 20 forward until the razor blade cartridge is free from the connection member 4.

Figure 6B:
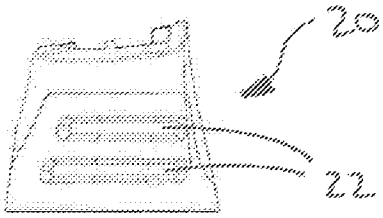
FIG. 6B is a side elevation of a preferred embodiment of the pusher shown in FIG. 6A.
Figure 6A:
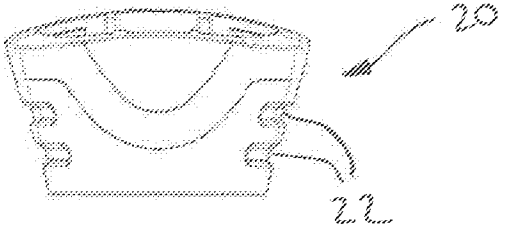
FIG. 6A is a front elevation of a preferred embodiment of a pusher for use with the handle of the present invention shown in FIG. 5A.
Figure 12C:
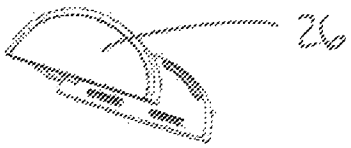
FIG. 12C is a perspective view of a preferred embodiment of the overmolded element of the pusher shown in FIG. 12A.
Figure 12B:
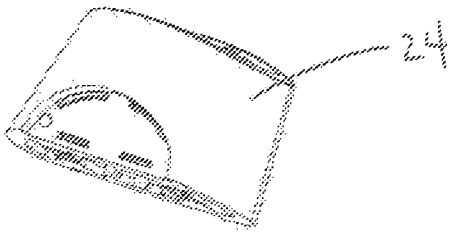
FIG. 12B is a perspective view of a preferred embodiment of the base element of the pusher shown in FIG. 12A.
Figure 12A:
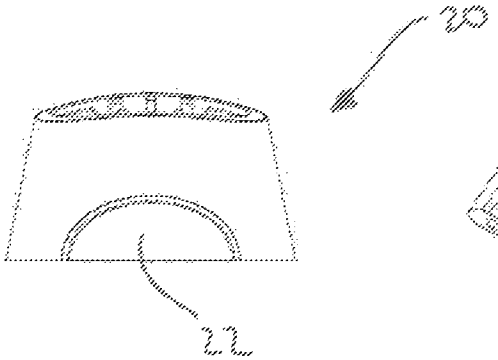
FIG. 12A is a front elevation of a preferred embodiment of a pusher for use with the handle of the present invention shown in FIG. 11.
Figure 7:
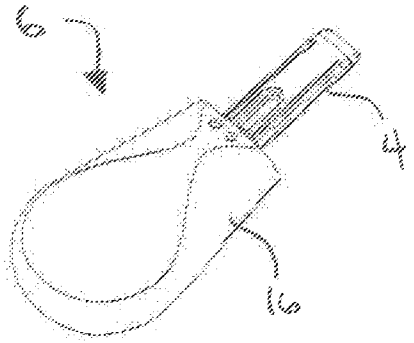
FIG. 7 is a perspective view of another preferred embodiment of the core member of the present invention, with a unitary connection member.
Figure 8:
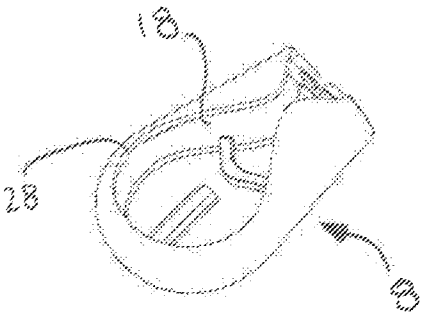
FIG. 8 is a perspective view of another preferred embodiment of the cap member for use with the core member shown in FIG. 7.
Figure 9:
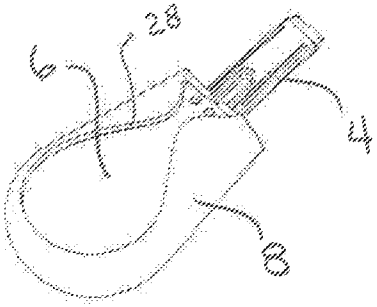
FIG. 9 is a perspective view of another preferred embodiment of the core member of the present invention shown in FIG. 7 with the cap member attached.
Figure 11:
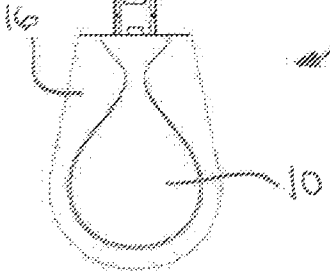
FIG. 11 is a front elevation of another preferred embodiment of the handle of the present invention with the overmolded member molded over the core member and bounded by the cap about the distal end.
Figure 10:
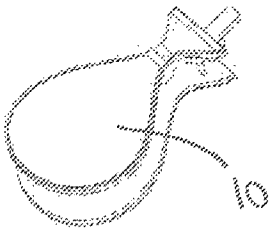
FIG. 10 is a perspective view of the preferred embodiment of the overmolded member of the handle as applied to the core member with cap member attached as shown in FIG. 9, to arrive at the handle as shown in FIG. 11.

When used, the pusher 20 may have grip elements 22 formed thereon to aid in manually engaging the pusher 20 for sliding it along the connection member 4. The grip elements 22 may be elements formed into a surface of the pusher 20, such as grooves or cuts in the pusher 20 as shown in FIGS. 6A-6C, or may be one or more molded elements 24 formed of a tactile material, such as TPE or TPR to match the overmolded member 10 on the razor handle 2, molded onto a pusher core 26 as shown in FIGS. 12A-12C. The pusher 20 may be formed independently of the razor handle 2 and attached to the razor handle 2 by sliding it onto the connection member 4.

Alternatively, the razor handle 2 can incorporate a dynamic connection member 4 (not shown) for retaining the razor blade cartridge on the razor handle 2, as is also known in the art.

Figure 13B:
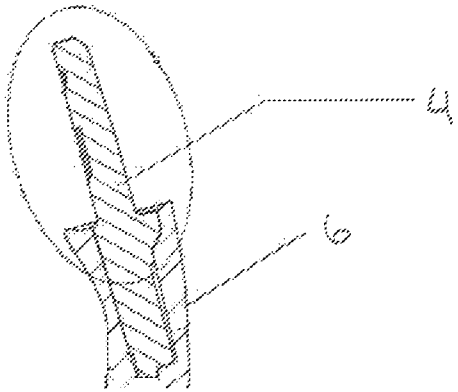
FIG. 13B is a cross-sectional view of the connection member of FIG. 13A attached to the razor handle of the present invention.
Figure 13A:
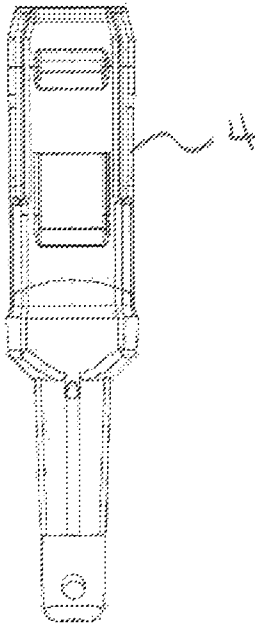
FIG. 13A is a front elevation of an embodiment of a connection member that is separately formed and attached to the razor handle of the present invention.

When either a static connection member or a dynamic connection member is used, it can be incorporated directly into the core member 6 (as shown in FIGS. 1C and 1D) or it can be formed separately and attached to the razor handle 2, and preferably the core member 6, during manufacture (as shown in FIGS. 13A and 13B) or after the remainder of the razor handle 2 has been manufactured, as is known in the art.

The preferred method of manufacturing the razor handle 2 of the present invention comprises the steps of forming a core member 6, forming a cap member 8 independent of the core member 6, attaching the cap member 8 to a terminal portion 16 of the core member 6, injection molding an overmolded member 10 over at least a portion of the core member 6 to form at least a portion of an exterior surface of the razor handle 2, wherein the overmolded member 10 is bounded at least in part by the cap member 8 and at least a portion of the cap member 8 and the overmolded member 10 form at least a portion of an outer surface of the razor handle 2.

The step of forming the core member 6 may include forming a unitary material into the shape of the core member 6 or forming composite parts including a weighted element 12 and a covering element 14 into the core member. The core member 6 formed of a unitary material can be formed by any means, including casting, forging, milling, machining, etc., and may comprise a metal, wood, plastic, resin, synthetic, or other natural or manmade material by injection molding, casting, machining, etc. Most preferably, however, the unitary core member 6 is formed by injection molding a plastic material comprising polycarbonate with glass fiber reinforcement.

When forming the core member 6 with a composite structure, it is preferred that the weighted element 12 be formed of a metal, plastic or other suitable material by casting, milling, machining, molding or other suitable process. Once the weighted element 12 is formed, it is preferably placed within the cavity of an injection molding machine where the covering element 14, the material of which can be any suitable material with plastic being preferred and polycarbonate with glass fiber reinforcement being most preferred, is injection molded over the weighted element 12. In its most preferred embodiment, the covering element 14 fully covers the weighted element 12.

As shown in the drawings (i.e., FIGS. 1A, 1C, 3C, 4A, 4B and 5C) holes are provided on the weighted element 12 so that the it can be temporarily attached to a fixture, such as a stand, before being placed into the mold cavity that forms the covering element 14. These holes are then extended to the covering element 14, since the fixture or stand remains attached to the weighted element 12 during formation of the covering element 14. Once the covering element 14 is formed, the fixture is removed and the core member 6 with the cap member 8 attached is placed in a mold cavity for forming the overmolded member 19 where the holes are covered by injection molding the material of the overmolded member 10 thereover.

With either the unitary or composite core member 6, the connection member 4 or a portion thereof can be integrally formed with the core member 6 or later attached to the razor handle 2, and preferably to the core member 6. In keeping, a preferred embodiment includes forming a connection member 8 or part thereof as part of the core member 6. Alternatively, the additional step of attaching at least a portion of the connection member 4 to the razor handle 2, and preferably to the core member 6 of the razor handle 2 is contemplated.

The cap member 8 is preferably formed by injection molding a plastic material, and preferably ABS plastic, into the desired shape. The core member 6 preferably comprises forming the cap member 8 with a hollow portion 18 for receiving a terminal portion 16 of the core member 8. The hollow portion 18 of the cap member 8 is placed over the terminal portion of the core member 8 and is attached thereto by any suitable means, including friction, spring force, molding, heat bonding, chemical bonding, adhesives, including resins, glues, etc. Additionally, the forming of the overmolded member 10 on the core member 6 and a portion of the cap member 8 may assist in holding the cap member 8 onto the core member 6.

Once the cap member 8 is attached to the core member 6 the overmolded member 10 is formed on the core member 6, with the overmolded member 10 optionally covering a portion of the cap member 8. In the preferred embodiment, the core member 6 with attached cap member 8 is placed into an injection molding machine with a cavity that excludes formation of the overmolded member 10 over at least a portion of the cap member 8, and preferably up to a ledge 28 formed by the cap member 8 on the core member 6 that preferably defines the thickness of the overmolded member 10 on the core member 6.

In a preferred embodiment, the cavity of the mold parts used to form the overmolded member 10 in the injection molding machine includes elements for creating surface features 30 on the outer surface of the overmolded member 10. Although any surface features may be used, it is preferred that the surface features 30 provide additional friction for gripping the razor handle 2 even when wet.

If the razor handle 2 has a static connection member 4 and a pusher 20 is used, the pusher 20 is preferably formed at least in part by injection molding. In a preferred embodiment, the pusher 20 is formed of a unitary material, however, another preferred embodiment contemplates that the pusher 20 have a pusher core 24 formed by injection molding which then has a molded element 26 molded thereon. Once formed, the pusher 20 is preferably manually pressed onto the connection member 4 and is held there by one or more stop members that prohibit the pusher from sliding off of the connection member 10.

While certain exemplary embodiments have been described and shown in the accompanying drawings, it is to be understood that such embodiments are merely illustrative and not restrictive of the current invention, and that this invention is not restricted to the specific constructions and arrangements shown and described since variation, modification, and/or alternatives can occur to those ordinarily skilled in the art. All such variations, modifications and/or alternatives are intended to fall within the scope of the present invention.

The term "comprising" as used in the following claims is an open-ended transitional term that is intended to include additional elements not specifically recited in the claims. It is also noted that any feature or element positively identified in this document may also be specifically excluded as a feature or element of an embodiment of the present invention.

Any and all patents and/or patent applications referred to herein are hereby incorporated by reference.

The invention claimed is:

1. A razor handle comprising a connection member adapted to connect a razor blade cartridge to the handle, a core member comprising a terminal portion, a cap member comprising a hollow portion that receives and covers the entire terminal portion of the core member for fixed attachment of the cap member to the core member and the cap member also comprising a ledge, and an overmolded member formed by injection molding integrally onto at least a portion of the core member and a portion of the cap member bounded by the ledge, said overmolded member entirely surrounding at least a portion of a periphery of the core member and a periphery of the cap member up to the ledge, the ledge forming a boundary of the overmolded member during the injection molding of the overmolded member, where the overmolded member and cap member form portions of an exterior surface of the handle.

2. The razor handle of claim 1 wherein at least a portion of the connection member is integrally formed as a unitary element with the core member at an end of the core member opposite the terminal portion.

3. The razor handle of claim 1 wherein at least a portion of the connection member is formed as an independent element which is attached to the razor handle.

4. The razor handle of claim 1 wherein the core member comprises a weighted element and a covering element, wherein the weighted element is integrally formed with and non-removable from the covering element.

5. The razor handle of claim 4 wherein the weighted element is formed of a metal.

6. The razor handle of claim 1 wherein the ledge of the cap member determines the thickness of the overmolded member at the point where the overmolded member is bounded by the cap member.

7. The razor handle of claim 1 wherein the cap member comprises a plastic material.

8. The razor handle of claim 1 wherein the overmolded member is formed of a material taken from the group consisting of a plastic material, a TPE material and a TPR material.

9. The razor handle of claim 1 wherein the overmolded member comprises surface features to improve grip.

10. The razor handle of claim 1 further comprising a pusher for pushing a razor blade cartridge off of the connection member.

* * * * *